US005663700A

United States Patent [19]

Spence et al.

[11] Patent Number: 5,663,700

[45] Date of Patent: Sep. 2, 1997

[54] SOUND DAMPENING SOLENOID

[75] Inventors: Glen C. Spence, New Berlin; Dennis A. Maller, Racine, both of Wis.

[73] Assignee: Trombetta Corporation, Milwaukee, Wis.

[21] Appl. No.: 519,674

[22] Filed: Aug. 25, 1995

[51] Int. Cl.[6] ..... H01F 3/00

[52] U.S. Cl. ..... 335/257

[58] Field of Search ..... 335/257, 258, 335/255, 262; 251/129, 141, 282

[56] References Cited

U.S. PATENT DOCUMENTS

| | | | |
|---|---|---|---|
| Re. 32,783 | 11/1988 | Clark . | |
| 1,518,020 | 12/1924 | Traver . | |
| 3,010,055 | 11/1961 | Nicolaus . | |
| 3,552,627 | 1/1971 | Moreno | 227/131 |
| 4,131,866 | 12/1978 | Torr . | |
| 4,142,169 | 2/1979 | Katchka et al. . | |
| 4,153,890 | 5/1979 | Coors . | |
| 4,449,691 | 5/1984 | Fuehrer | 251/85 |
| 4,766,405 | 8/1988 | Daly et al. | 335/257 |
| 4,896,127 | 1/1990 | Hida . | |
| 5,127,624 | 7/1992 | Domke | 251/129 |

FOREIGN PATENT DOCUMENTS

| | | |
|---|---|---|
| 819376 | 9/1959 | United Kingdom . |

*Primary Examiner*—Lincoln Donovan
*Attorney, Agent, or Firm*—Wheeler Kromholz & Manion

[57] ABSTRACT

A sound dampened solenoid utilizes pneumatic dampening to quiet the sound during the plunger's movement. An O-ring is mounted around the outer diameter of the pole piece thus sealing the pole piece to the solenoid tube. A seal is placed in the pole piece opening where the plunger push rod passes through. A pair of low friction wear bands are wrapped around the plunger. Small gaps are formed where the ends of each wear band meet. A second O-ring is located under one of the wear bands to form a seal between the plunger and the tube. In a pull solenoid, when the solenoid is energized the plunger begins to accelerate toward the pole piece causing the volume of air within the tube between the plunger assembly and pole piece to shrink. The only path for air trapped within to escape is through the gaps in the wear bands. Air is forced through the gaps at a slower rate than the rate of volume change. Air pressure within the volume rises slowing the plunger acceleration and quieting its operation. A method for sound dampening solenoids is also disclosed.

22 Claims, 5 Drawing Sheets

SOUND DAMPENING SOLENOID

BACKGROUND OF THE INVENTION

Solenoids are well known in the art and are often utilized as a means for moving a component a predetermined distance at a predetermined time. In its most basic form, a solenoid is an electro-mechanical device which converts electrical energy into linear or rotary motion. Current passes through a coil of insulated copper wire producing a magnetic field which moves a ferro-magnetic plunger located within the core of the coil. Steel parts surround the coil to contain the flux path for maximum pull, push or rotational force. A typical solenoid comprises a steel frame or shell which surrounds the coil of wire and directs the flux path. The coil, when energized, creates the magnetic lines of force. A plunger, located within the coil, reacts to the magnetic pull and moves to the center of the coil against a stop or pole piece.

A solenoid can be utilized to open a valve, activate a switch, apply a brake, or a number of other activities where mechanical movement is required and only an electrical energy source is available or practical.

A typical solenoid structure includes movable components as well as non-movable or stationary components. The stationary components include a bottom plate, a housing, a tube having a coil assembly, and a top plate. A pole piece may be attached to the bottom plate. A movable plunger assembly is located within the tube. A rod is attached to one end of the plunger. The rod transfers the mechanical movement of the plunger to the device requiring the movement.

When an electrical current is applied to the coil assembly, the plunger moves quickly in a predetermined direction toward a stop or pole piece. The pole piece provides a stop for the plunger movement. However, when the plunger and stop strike each other at the end of the stroke, a loud noise is produced. As the size of the solenoid increases, so does the level of noise produced.

It is an object of this invention to provide a solenoid assembly having sound dampened characteristics to produce substantially quiet operation. It is another object to provide a method of dampening unwanted sound from solenoids that are already in use in the field.

These and other objects of the present invention will become evident in the following descriptions. The inventors know of no prior art that teaches or discloses their invention.

SUMMARY OF THE INVENTION

The invention relates to solenoids and specifically sound dampened solenoids. The sound dampened solenoid utilizes pneumatic dampening to quiet the sound during the plunger's movement toward and against the stop or pole piece. Push, pull, or even rotary solenoids could be designed to operate quietly based upon the information and principles disclosed herein.

Sound dampening is achieved by sealing portions of the solenoid assembly and by providing sealing mechanisms or structures so that air is trapped within a cavity defined by the plunger, bottom plate or pole piece, and housing or tube within which the plunger travels.

In summary, the sound dampening solenoid, including a bottom plate, a plunger, and a tube having a first end, comprises the bottom plate or pole piece pneumatically Sealed to the tube first end, the plunger substantially pneumatically sealed within the tube, and the tube defining a substantially sealed pneumatic cavity formed by the bottom plate and the plunger. In another embodiment, the sound dampening solenoid, including a bottom plate having an opening, a plunger including a push rod, and a tube having a first end, comprises the bottom plate or pole piece pneumatically sealed to the tube first end, a sealing structure being located in the bottom plate opening for sealing the push rod within the opening, the plunger substantially pneumatically sealed within the tube, and the tube defining a substantially sealed pneumatic cavity formed by the bottom plate and the plunger.

Alternatively, the present invention could be described as a method for dampening unwanted sound from a "pull" solenoid including a bottom plate, a plunger, and a tube having a first end, the method comprising pneumatically sealing the bottom plate or pole piece to the tube first end and substantially pneumatically sealing the plunger within the tube. With respect to a "push" solenoid, the method for dampening unwanted sound would comprise pneumatically sealing the bottom plate or pole piece to the tube first end, pneumatically sealing the push rod within the bottom plate opening, and substantially pneumatically sealing the plunger within the tube.

DETAILED DESCRIPTION

Figure 1:
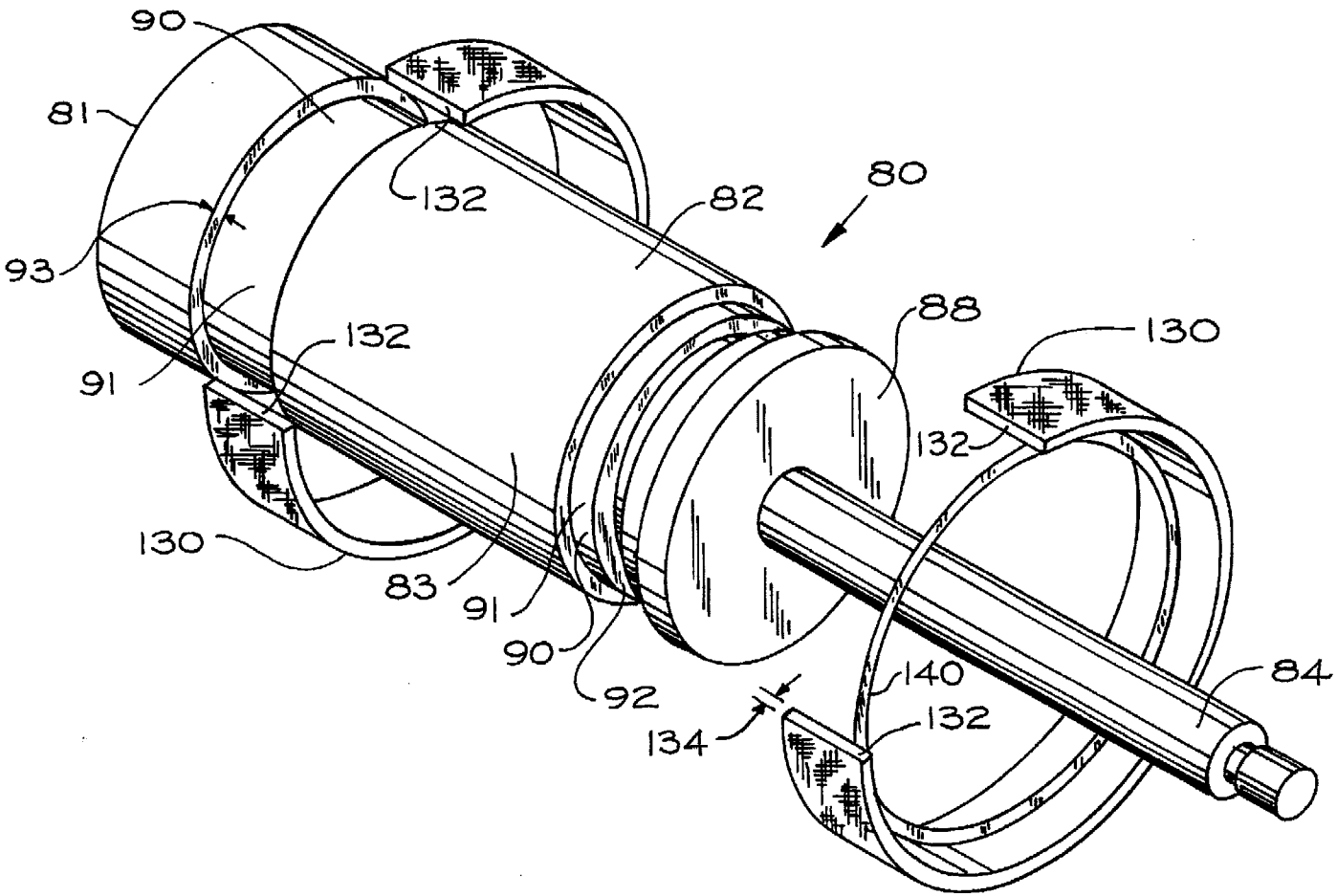
FIG. 1 is a perspective view of the plunger assembly.

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

The present invention comprises a sound dampened solenoid shown generally at 10 in the drawings. Referring to FIGS. 1 through 5, it may be seen that solenoids 10 generally include the following primary components: a bottom plate assembly 20, a tube assembly 60, a plunger assembly 80, and a front plate 100. The bottom plate assembly 20 includes a pole piece 40 attached to the interior side of the bottom plate 22. The tube assembly 60 includes a tube 62, typically made from brass, within which the plunger 82 travels and around which wire 64 is wrapped in a coil-like fashion. The plunger assembly 80 includes a plunger 82 made from a ferro-magnetic material and a rod 84 attached to one end for pushing, pulling, or rotating depending upon its orientation and position. In addition to the above, connecting devices 120 such as screws 122 having washers 124 are also provided for attaching the front plate 100 and bottom plate 20 to the ends 66 and 68 of the tube assembly 60.

Figure 4:
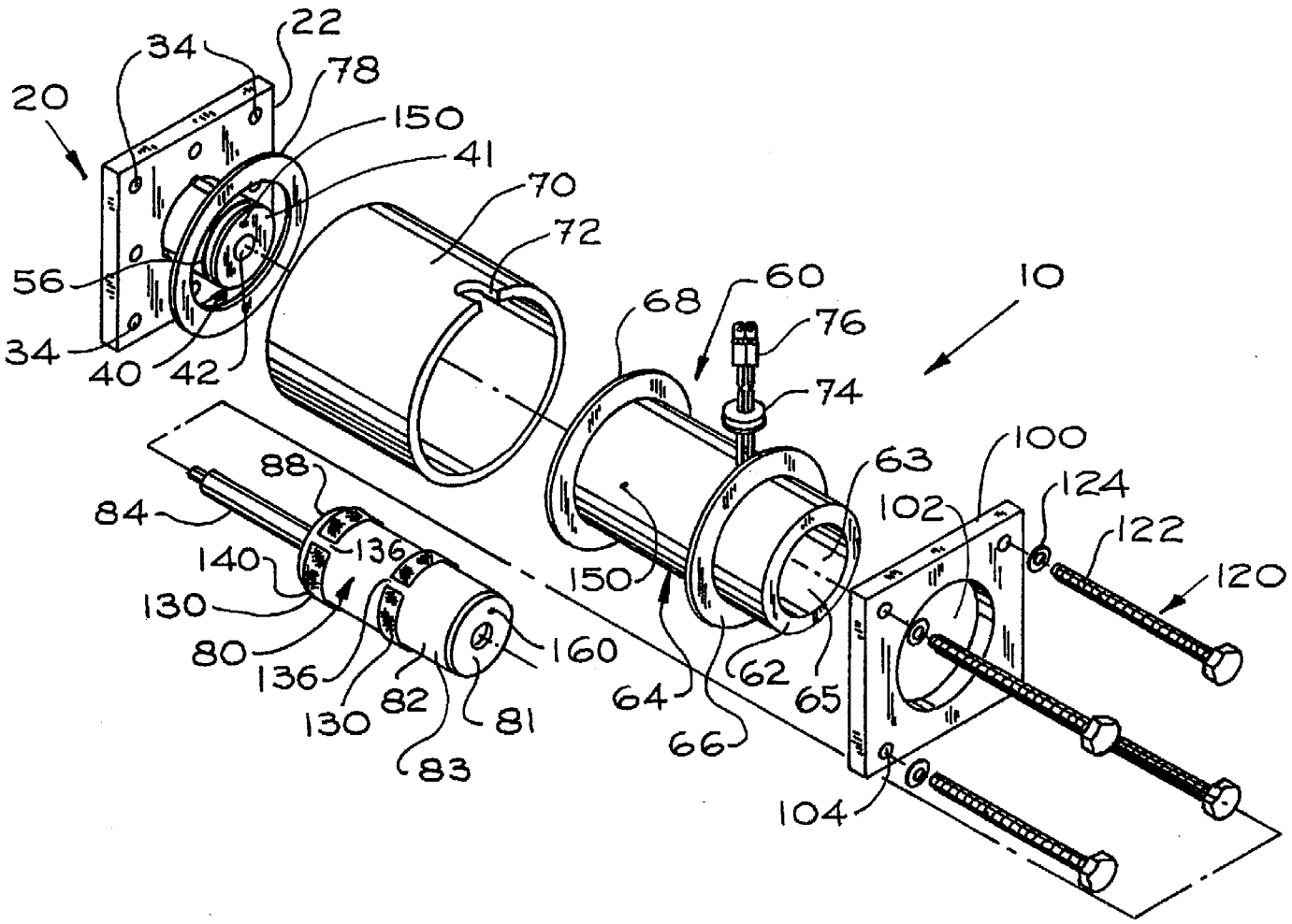
FIG. 4 is a perspective view of the solenoid assembly.
Figure 5:
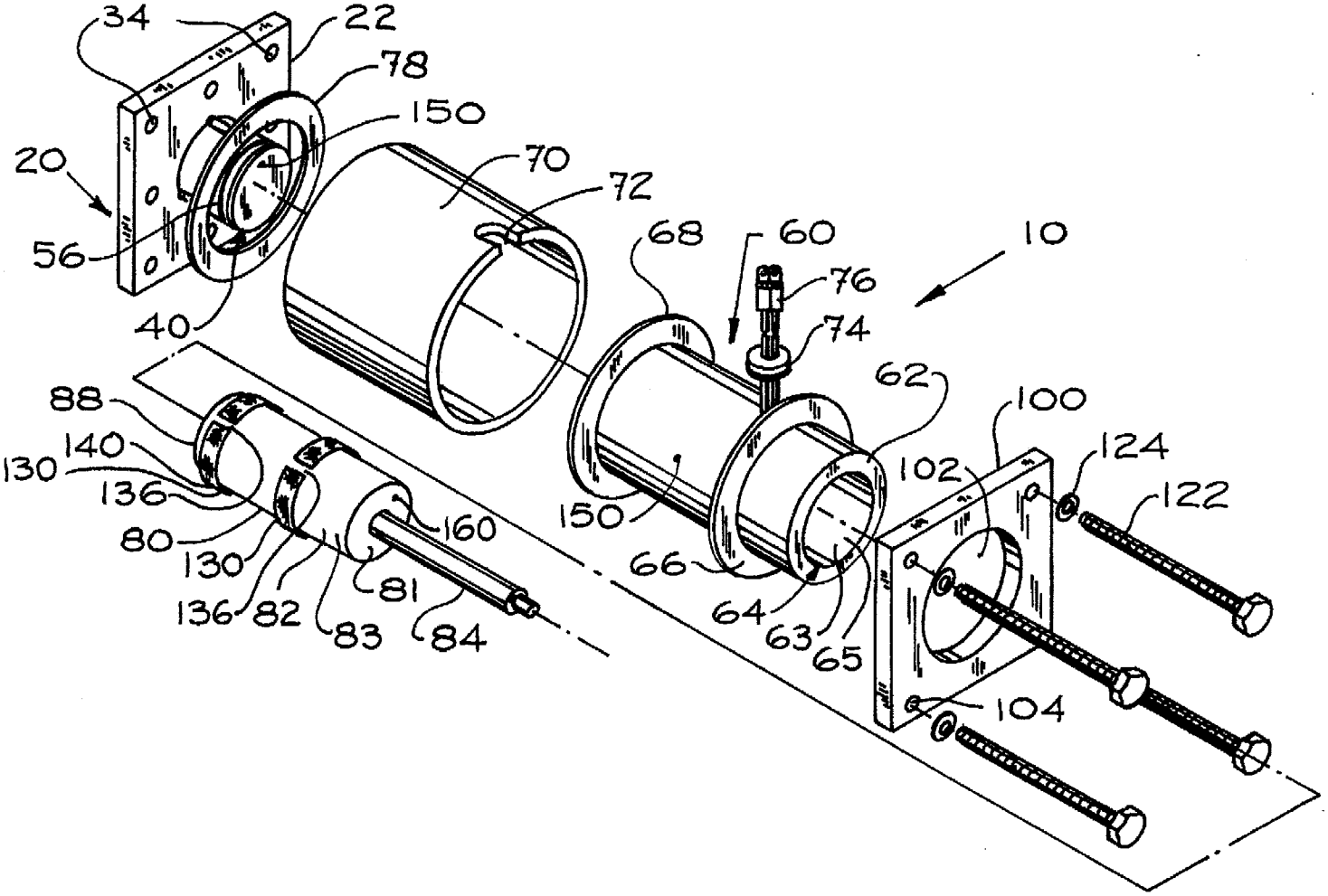
FIG. 5 is a perspective view of a pull version of the solenoid assembly.

The present invention 10 is best shown in FIGS. 4 and 5. FIG. 4 shows a "push" version of the sound dampened solenoid 10 and FIG. 5 shows a "pull" version of the sound dampened solenoid 10. In addition, a rotary version is discussed below.

FIG. 1 shows the plunger assembly 80 in detail. The plunger 82 is fabricated from a ferro-magnetic material, typically steel. The outer surface 83 of the plunger 82 is finely ground or polished to predetermined surface finish characteristics so that the plunger 82 protects the tube assembly 60 from incidental or transient contact with the plunger 82 during short-term side loading. Referring to FIG. 1 and a "push" version solenoid 10, it can be seen that the rod 84 is connected to the plunger 82 at end 88. Alternatively, rod 84 could be connected to end 81 to form a "pull" version solenoid 10. Two wide grooves 90 are formed around the outer periphery of plunger 82. In the groove 90 closest to end 88, a second narrower grove 92 is formed in the base of the wide groove 90.

An O-ring 140 is placed in the smaller groove 92. The O-ring 140 is a #32 O-ring of 75 durometer, is made of viton, has a commercial grade, and is manufactured by Specification Seals Co. of Anaheim, Calif.

The wide grooves 90 receive wear bands 130 about the periphery of the plunger 82 and maintain the position of the wear bands 130 as the plunger moves through tube 62. Wear bands 130 are formed from a low friction material such as filled TEFLON brand low friction material or MULTIFIL 426 brand bearing tape sold by Garlock Bearings Inc. of Thorofare, N.J. The wear bands 130 are rectangular in shape. Their width is slightly less than the width of the grooves 90. Each band 130 is wrapped about a groove 90 so that it substantially fills the groove 90. The length of each band 130 is slightly less than the outer perimeter of the base 91 of groove 90 to provide an air gap 136 between the ends 132 of each band 130. The air gaps 136 are shown in FIGS. 4 and 5. Their significance will be discussed below. The thickness 134 of each band 130 is approximately 0.0625 inches (0.158 cm). This is slightly greater than each groove height 93.

The wear band 130 closest to plunger end 88 rides on O-ring 140 within groove 90. O-ring 140 biases wear band 130 in an outward direction and provides a seal between the wear band 130 and O-ring 140 and provides a seal between the plunger 82 and the O-ring 140. With the exception of air gap 136, a seal is also formed between the wear band 130 and the tube wall 63 of tube 62 upon which the wear band 130 rides. Thus, plunger assembly 80 is substantially slidably sealed within tube assembly 60.

Figure 2:
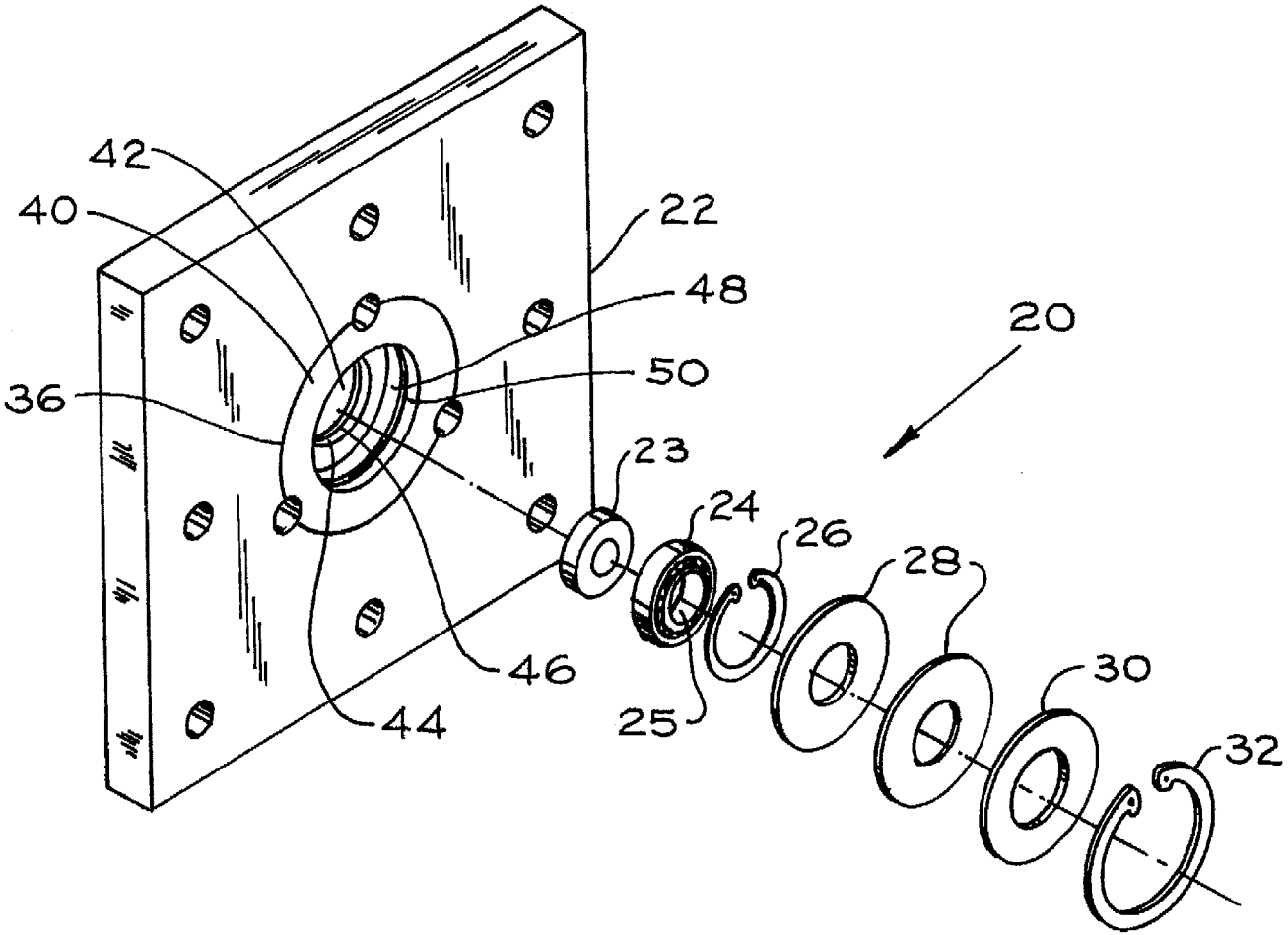
FIG. 2 is a perspective view of the exterior side of the bottom plate assembly.
Figure 3:
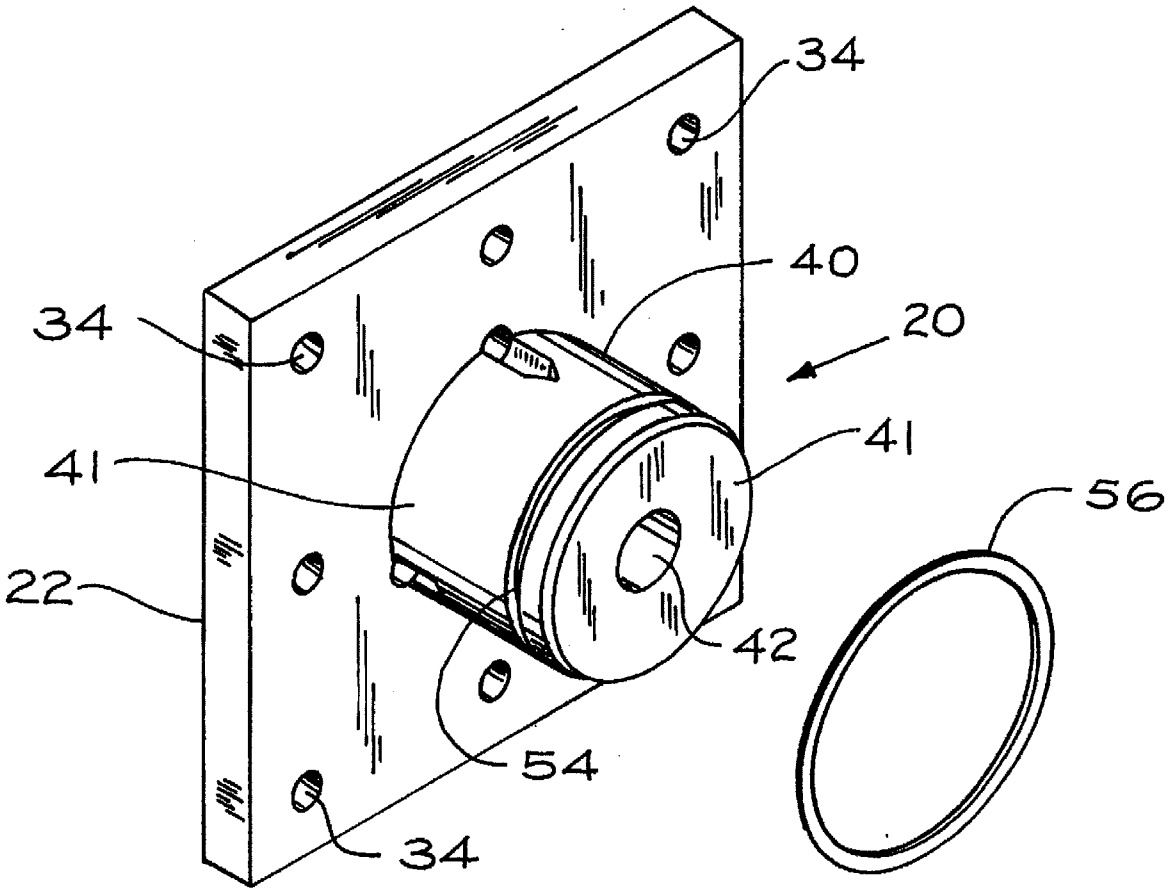
FIG. 3 is a perspective view of the interior side of the bottom plate assembly.

The bottom plate assembly 20 is shown in FIGS. 2 and 3. FIG. 2 is a view of the exterior side and FIG. 3 is a view of the interior side. The assembly 20 includes the pole piece 40, a bottom plate 22, a bronze bushing 23, a seal 24, a first retaining ring 26, a pair of felt washers 28, a steel washer 30, and a second retaining ring 32. The bronze bushing 23 is oil impregnated and is of the type manufactured by Bunting Bearing Corp. of Holland, Ohio. The seal 24 is a polyurethane seal of the type manufactured by Macrotech of Salt Lake City, Utah. The felt washers 28 comply with the specifications set forth at SAE F-50 and ASTM No. CF-206. They are of the type manufactured by Aetna Felt Corp. of Allentown, Pa. The retaining rings 26 and 32 are sizes HO-77 and HO-125 respectively. Each has a PA finish and is of the type manufactured by Rotor Clip Company, Inc. of Somerset, N.J. Steel washer 30 is typically fabricated from 18-8 stainless steel and complies with AN960-1016L dimension specifications.

Within the bottom plate 22 is an opening 36. The pole piece 40 fits into and is attached within opening 36. The pole piece 40 remains within opening 36 by means of a interference or friction fit between the components. The pole piece 40 has an opening 42 through which the rod 84 of the plunger assembly 80 passes on a "push" version solenoid 10. Within opening 42, there is formed a first shoulder 44 against which bronze bushing 23 rests when it has been fully pressed into opening 42. The function of the bronze bushing 23 is maintain plunger rod 84 in a centered position within opening 42 and to prevent the shaft 84 from offset loading or tearing seal 24. After the bushing 23 has been pressed into the opening 42, seal 24 is next pressed in until it rests against bronze bushing 23. A first snap ring groove 46 within opening 42 receives first snap ring 26. Snap ring 26 prevents the seal 24 from being removed from pole piece opening 42 during a stroke of plunger rod 84.

Next within opening 42, a second shoulder 48 is formed against which the pair of felt washers 28 and steel washer 30 rest. A second snap ring groove 50 is provided for receiving second snap ring 32. Snap ring 32 holds felt washers 28 and steel washer 30 between shoulder 48 and itself.

The inner diameter of seal 24 forms a pneumatic seal around rod 84 and prevents the escape of air past the seal 24. The felt washers 28 and steel washer 30 extend the life of the seal 24 by wiping and lubricating the solenoid rod 84. The wiping action clears debris from the rod 84 thus preventing debris from reaching the seal 24. Exposing the seal 24 to debris could affect its integrity and shorten its working life. Steel washer 30 rests directly on top of felt washers 28. Second snap ring 32 sits directly on top of steel washer 30.

In FIG. 3, the interior side of bottom plate assembly 20 is shown. This is the side opposite the side shown in FIG. 2. Protruding from plate 22, the pole piece or stop 40 can be seen. Pole piece opening 42 is also shown. Around the outer periphery 41 of pole piece 40, a groove 54 is formed. The groove 54 is sized to receive an O-ring 56. O-ring 56 is a #33 O-ring of 75 durometer, is made of viton, has a commercial grade, and is manufactured by Specification Seals Co. of Anaheim, Calif. When the tube assembly 60 is placed over the pole piece 40, the O-ring 56 seals the pole piece 40 to the interior wall 63 of the tube 62.

Alternatively, a groove having diameters substantially equivalent to the inner and outer diameters of tube 62 could be formed in the bottom plate 20. An O-ring or other sealing structure could be placed within the groove. Tube assembly 60 would be sealed to bottom plate assembly 40 by the O-ring or other sealing device when end 68 of tube 62 was placed into the groove.

It would also be possible to simply seal the end 68 of tube 62 to bottom plate 22 using a sealing structure. The sealing structure could include, but is not limited to, a rubber seal, a plastic seal, a liquid seal, a metal seal, a mechanical seal, or a chemical seal.

Now referring to FIG. 4, it can be seen that pole piece 40 and bottom plate 22 receive the end 68 of tube 62 of tube assembly 60. A wave spring 78 is placed between bottom plate 22 and the end of tube assembly 68. Wave spring 78 insures that tube assembly 60 is firmly secured between bottom plate 22 and top plate 100. As tube end 68 is placed over pole piece 40, O-ring 56 creates a seal between the inner wall 63 of tube 62 and pole piece 40.

A housing 70 is placed over tube assembly 60 including tube 62 and wire coil 64. An opening 72 is formed in housing 70 for receiving grommet 74. Wire coil 64 lead wires 76 are passed through grommet 74 to prevent breakage and abrasion during solenoid use. Solenoid 10 is energized by providing an electrical current to lead wires 76.

Next, top plate 100 is placed over the opposite end of tube 62. Opening 102 in top plate 100 passes over the end of tube 62 until top plate 100 comes to rest against coil tube stop 66. The components are secured together by fasteners 120. Four screws 122 having lock washers 124 pass through openings 104 in top plate 100. The screws are threadedly engaged into threaded openings 34 in bottom plate 22.

Finally, plunger assembly 80 is inserted into tube 62. In a "push" version solenoid 10, rod 84 passes through opening 42 in pole piece 40 and opening 25 in seal 24. In a "pull" version, rod 84 passes through opening 65 in tube 62. In the "pull" version, and as shown in FIG. 5, no opening 42 is formed in pole piece 40.

An air chamber is formed between the end portion 41 of pole piece 40, the inner walls 63 of tube 62, and the end 88 of plunger 80. O-ring 56 prevents air from escaping at the interface of the tube 62 and pole piece 40. Seal 24 prevents air from escaping around rod 84 as it passes through opening 42 in pole piece 40. O-ring 140 biases wear band 130 outward toward inner wall 63 of tube 62 and thus creates a seal between tube wall 63 and plunger 80.

In the preferred embodiment, the only place where air can escape from the defined chamber is through the air bleed passage or gap 136 in the ends 132 of wear bands 130. By controlling the size of the air gap 136, the amount of air permitted to escape from the defined chamber can be carefully controlled or regulated. The size of the air gap 136 is determined by the characteristics of the solenoid 10 that is used. In the embodiment specifically disclosed herein the area of the air gap 136 should be approximately 0.0136 square inches. This is because a sound reduction of approximately 60% is desired and the solenoid 10 disclosed herein contains approximately 4.31 cubic inches of air volume which is compressed by the application of approximately 300 linear pounds of force through the plunger assembly 80. Accordingly, an air gap 136 having an area of 0.0136 square inches will provide the necessary rate of air flow relief given the characteristics of the solenoid 10 and the desired level of sound reduction.

In an alternative embodiment, an air bleed passage or opening 150 is formed in either the tube assembly 60 or bottom plate assembly 20. In this embodiment, the air gap 136 in each wear band 130 is substantially eliminated. The only place where air can escape from the defined chamber is through the air bleed passage or opening 150. By controlling the size of the opening 150, the amount of air permitted to escape from the defined chamber can be carefully controlled or regulated. The size of the opening 150 is determined by the characteristics of the solenoid 10 that is used. In the alternative embodiment specifically disclosed herein the area of the opening 150 should be approximately 0.0136 square inches. This is because a sound reduction of approximately 60% is desired and the solenoid 10 disclosed herein contains approximately 4.31 cubic inches of air volume which is compressed by the application of approximately 300 linear pounds of force through the plunger assembly 80. Accordingly, an opening 150 having an area of 0.0136 square inches will provide the necessary rate of air flow relief given the characteristics of the solenoid 10 and the desired level of sound reduction.

In yet another alternative embodiment of the solenoid 10, an opening or air bleed passage 160 is formed through the plunger assembly 80. The opening 160 provides the only place where air can escape from the defined chamber as the plunger 82 accelerates toward the bottom plate 22.

When the solenoid 10 is energized, the plunger 80 begins to accelerate toward the pole piece 40. This causes the volume of air trapped in the defined chamber to decrease. The only path for the air inside the chamber to escape, neglecting nominal leaks past wear bands 130, O-ring 140, O-ring 56, and seal 24, is through the gaps created at the ends 132 of wear bands 130. Air is forced through these gaps at a slower rate than the rate of volume change within the chamber. Air pressure within the chamber rises thus slowing the plunger 80 acceleration and dampening its operation. A substantially quiet solenoid 10 operation is achieved.

Alternatively, the present invention 10 could be described as a method for dampening unwanted sound from a solenoid. The method comprises the steps of sealing the solenoid pole piece 40 to the solenoid tube 60, sealing the plunger rod 84 as it passes through the opening 42 in the pole piece 40, and sealing a predetermined peripheral portion of the plunger 80 to the inner wall 63 of the tube 62. If the solenoid 10 is a pull solenoid, only the pole piece 40 is sealed to the tube 60 and the predetermined peripheral portion of the plunger 80 is sealed to the inner wall 63 of the tube 62.

In both situations, an air chamber is created within the tube 62 between the pole piece 40 and plunger end 88. Changing the volume of air within the chamber during plunger 80 acceleration dampens the sound characteristics of the solenoid 10.

In addition to pull and push type solenoids, the above principles can be applied to a rotary solenoid. The rod 84 of a rotary solenoid produces a rotational motion through known mechanical means during plunger 82 travel. Substantially the same sealing structures can be applied to the rotary solenoid in substantially the same manner to produce substantially the same result.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A sound dampening solenoid including a bottom plate assembly, a plunger assembly, and a tube having a first end, the sound dampening solenoid comprising:

the bottom plate assembly coupled to the tube first end;

a pneumatic seal located substantially between the tube first end and the bottom plate assembly;

the plunger assembly substantially pneumatically sealed within the tube; and the tube defining a substantially sealed pneumatic cavity formed by the bottom plate assembly and the plunger assembly.

2. The sound dampening solenoid of claim 1 wherein the bottom plate assembly includes a pole piece.

3. A sound dampening solenoid including a bottom plate assembly including an opening, a plunger including a push rod, and a tube having a first end, the sound dampening solenoid comprising:

the bottom plate assembly pneumatically sealed to the tube first end;

a sealing structure being located in the bottom plate assembly opening for sealing the push rod within the opening;

the plunger substantially pneumatically sealed within the tube; and the tube defining a substantially sealed pneumatic cavity formed by the bottom plate and the plunger.

4. The sound dampening solenoid of claim 3 wherein the bottom plate assembly includes a pole piece.

5. Sound dampened solenoid having a bottom plate including a bottom plate opening, a plunger having a push rod, the push rod passing through the bottom plate opening, a tubular structure having a first end and a second end, a top plate, the first end connected to the bottom plate and the second end connected to the top plate, the sound dampened solenoid comprising:

a first sealing structure located between the bottom plate and the tubular structure;

a second sealing structure located in the bottom plate opening; and a third sealing structure, including an air gap, located between the plunger and the tubular structure.

6. The sound dampening solenoid of claim 5 wherein the first sealing structure comprises an O-ring.

7. The sound dampening solenoid of claim 5 wherein the second sealing structure comprises a seal.

8. The sound dampening solenoid of claim 5 wherein the third sealing structure comprises an O-ring.

9. Sound dampened solenoid having a bottom plate assembly including a bottom plate and a bottom plate opening, a plunger having a push rod, the push rod passing through the bottom plate opening, a tubular structure having a first end and a second end, a top plate, the first end connected to the bottom plate and the second end connected to the top plate, the sound dampened solenoid comprising:

a first sealing structure located between the bottom plate and the tubular structure;

a second sealing structure located in the bottom plate opening;

a third sealing structure located between the plunger and the tubular structure; and an air bleed passage formed in the bottom plate assembly.

10. The sound dampened solenoid of claim 9 wherein the air bleed passage is formed in the tubular structure.

11. The sound dampened solenoid of claim 9 wherein the first sealing structure comprises an O-ring.

12. The sound dampened solenoid of claim 9 wherein the second sealing structure comprises a seal.

13. The sound dampened solenoid of claim 9 wherein the third sealing structure comprises an O-ring.

14. A sound dampening solenoid having a bottom plate, a plunger, and a tube, the sound dampening solenoid comprising:

a first sealing means attached to the bottom plate and pneumatically sealing the bottom plate to the tube; and a second sealing means, including an air gap, attached around the plunger and substantially pneumatically sealing the plunger to the tube.

15. The sound dampening solenoid of claim 14 wherein the first sealing structure comprises an O-ring.

16. The sound dampening solenoid of claim 14 wherein the second sealing structure comprises an O-ring.

17. A sound dampening solenoid having a bottom plate assembly, a plunger, and a tube, the sound dampening solenoid comprising:

a first sealing means attached to the bottom plate and pneumatically sealing the bottom plate to the tube;

a second sealing means attached around the plunger and pneumatically sealing the plunger to the tube; and an air bleed passage formed in the bottom plate assembly.

18. The sound dampening solenoid of claim 17 wherein the air bleed passage is formed in the tube.

19. The sound dampening solenoid of claim 17 wherein the first sealing structure comprises an O-ring.

20. The sound dampening solenoid of claim 17 wherein the second sealing structure comprises an O-ring.

21. A method for dampening unwanted sound from a solenoid including a bottom plate assembly, a plunger assembly, and a tube having a first end, the method comprising:

pneumatically sealing the bottom plate assembly to the tube first end; and substantially pneumatically sealing the plunger assembly within the tube.

22. A method for dampening unwanted sound from a solenoid including a bottom plate assembly having an opening, a plunger assembly having a push rod, and a tube having a first end, the method comprising:

pneumatically sealing the bottom plate assembly to the tube first end;

pneumatically sealing the push rod within the bottom plate assembly opening; and substantially pneumatically sealing the plunger assembly within the tube.

* * * * *